US005967909A

United States Patent [19]

Broadbridge

[11] Patent Number: 5,967,909

[45] Date of Patent: Oct. 19, 1999

[54] DRIVING RANGE GOLF BALL TEE HOLDER

[76] Inventor: John Broadbridge, 7 Pheasant La., Bridgewater, Conn. 06752

[21] Appl. No.: 09/020,780

[22] Filed: Feb. 9, 1998

[51] Int. Cl.[6] ..... A63B 69/36

[52] U.S. Cl. ..... 473/386; 473/398

[58] Field of Search ..... 473/386, 387, 473/392, 393, 394, 396, 398, 400, 401, 405

[56] References Cited

U.S. PATENT DOCUMENTS

| | | | |
|---|---|---|---|
| 5,156,403 | 10/1992 | Martino | 473/396 |
| 5,743,819 | 4/1998 | Chun | 473/386 |
| 5,766,100 | 6/1998 | Dilmore | 473/398 |

*Primary Examiner*—Steven Wong
*Attorney, Agent, or Firm*—Dallett Hoopes

[57] ABSTRACT

The holder comprises a shank which extends up through an opening in the driving mat. The shank has its dished upper end flush with the top face of the mat to support the golf ball for practicing irons. A conventional golf tee is inserted in a slot at the top of the tee holder for practicing drives.

2 Claims, 1 Drawing Sheet

DRIVING RANGE GOLF BALL TEE HOLDER

FIELD OF THE INVENTION

This invention relates to a tee holder for use in golf driving ranges. More specifically, this holder is designed to support a conventional golf ball tee to provide a support with minimal undesired influence on the club head or ball at impact.

BACKGROUND OF THE INVENTION

In the typical driving range of the present day, a driving mat or carpet is usually supported on a wooden or concrete platform. The mat is formed with a tee-receiving opening, and the tee is in a form like an upsidedown toadstool. Specifically, the tee is rubber and comprises a circular flat base from the center of which extends upward a tubular shank. The base sits on the platform under the mat and the shank extends upward through the opening in the mat and terminates upwardly in an open end on which the golf ball is teed. Usually the tee as described extends up above the top of the mat as much as an inch. Generally there is no provision for height adjustment.

Patrons have complained that such teeing of the ball is unrealistic, that the ball is positioned too high and that height is not adjustable. Further, more experienced golfers have noticed that the resilient tee as described has, in being contacted by the club, affected the swing of the club, either arresting the acceleration of the club head through the ball or tending to angle the club head; that is, open or close the face at the critical impact instant.

SUMMARY OF THE INVENTION

The present invention is a golf ball support for a driving range. It comprises a driving mat or the like adapted to rest on the platform and having a bottom face and a top face at a given height above the bottom face. The mat has a tee-holder-receiving opening therethrough. The invention also comprises a golf ball tee holder in the form of a resilient flat base and an integral central upward tubular shank extending upward from the base. The tubular shank has a dished upper end formed with a central vertical slot comprising generally parallel side surfaces and rounded ends. The mat and base of the holder rest on the usual driving range platform. The tubular shank extends up through the opening in the mat and the top of the flat base is engaged by the bottom face of the mat surrounding the opening, the tubular shank having its upper end disposed at the given height to be flush with the top face of the mat.

The holder as described is preferably used in combination with a conventional wooden or plastic golf tee comprising a stem with an integral ball-supporting cup having a dished top surface. The golf tee is installed in the tee holder by having its stem disposed in the slot in the shank with the parallel side surfaces of the slot frictionally engaging opposite sides of the stem to adjustably support the tee in vertical disposition. Thus the tee may be raised or lowered to practice drives or iron tee shots as desired.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
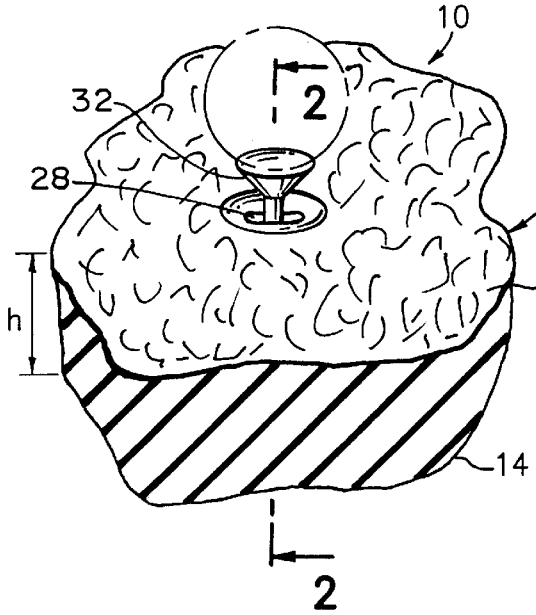
FIG. 1 is a perspective fragmentary view of a mat with the tee holder installed and a tee in place.
Figure 2:
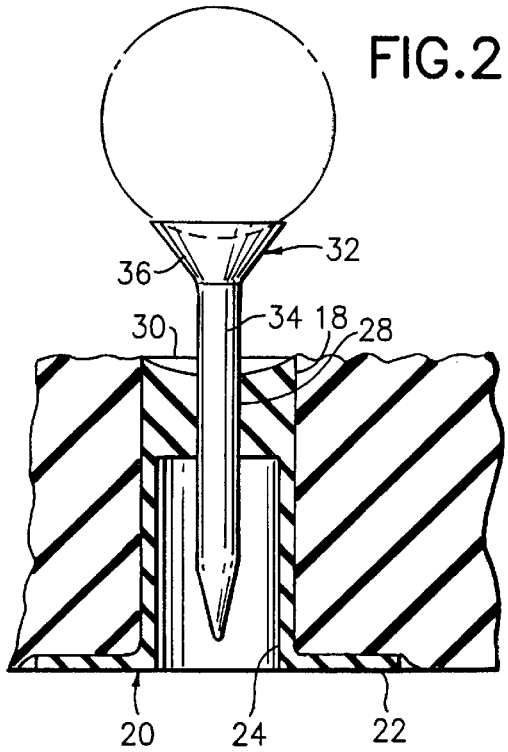
FIG. 2 is a fragmentary enlarged sectional view taken on the line 2—2 of FIG. 1.

Referring more specifically to the drawings, a golf ball support embodying the invention is generally designated 10 in FIG. 1. It comprises a mat 12 having a bottom face 14 and a top face 16 spaced above the bottom face by a given height h. The mat 12 is formed with a holder-receiving opening 18 therethrough.

A holder 20 is a rubber or plastic resilient element comprising a unitary circular base 22 and an upward tubular shank 24. The upper end 26 of the shank is thickened inwardly and formed with a slot 28. The top surface 30 of the holder 20 is dished and directly provides a support for the ball in practicing with irons or fairway woods.

Figure 4:
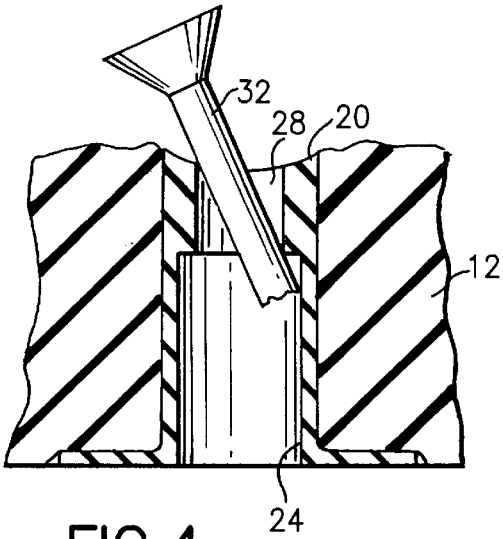
FIG. 4 is a fragmentary sectional view taken on the line 4—4 of FIG. 3 and showing a tee pivoted as after impact.
Figure 3:
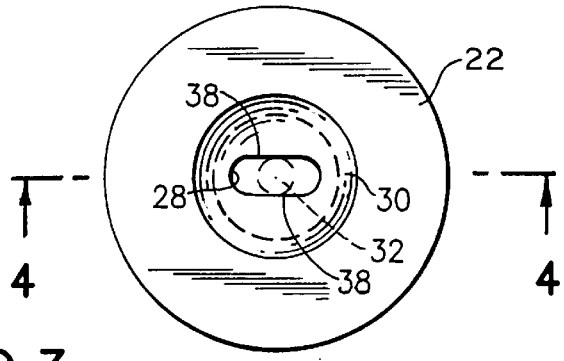
FIG. 3 is a top plan view of a tee holder with the tee shown only in dotted lines.

For practicing drives, a conventional wooden or plastic tee 32 or broken-off tee (FIG. 4) is installed on the holder 20 and comprises a stem 34 having the usual top cup 36. The stem is inserted in the slot 28 in the resilient thickened upper end 26 of the shank 24. As shown in FIG. 3, the opposite sides of the slot 28 have parallel vertical surfaces 38 and the conventional tee 32 (shown dotted FIG. 3) is frictionally held in place by the resilient parallel walls 38, slightly closer together than the diameter of the tee stem 34. The holder 20 is positioned so that the slot is disposed in the direction of the proposed flight of the ball (arrow FIG. 3).

The holder 20 may be installed in the mat by lifting up the mat and inserting the shank upward into the opening 18 and then permitting the mat to flop back onto the platform which supports it. In this manner the base 22 sits on the platform and is covered by the bottom face 14 of the mat.

With the conventional tee 32 installed in the holder 20, the patron will practice irons and shorter woods by placing the ball in a "tight lie" on the dished upper surface 30 of the holder. Such placement serves as a ball immobilizer and assures the patron the same positioning of the ball each time.

For practicing driving, the patron inserts the stem of the usual wooden or plastic tee 32 into the slot 28 in the holder and may adjust the height at which the conventional tee is frictionally held in the holder by merely sliding the tee up or down in the slot 28 to practice drives or iron tee shots.

When the patron contacts the ball at the bottom of his downswing, the tee is impacted in the usual way it is in a golf course tee box. The tee pivots forward in its slot (FIG. 4 wherein is shown a broken-off tee in use) or may be torn out of the slot altogether as in real play. Thus, using the present holder, the patron experiences the more realistic and negligible influences of the tee on his drive. This is a decided advantage of the present structure which advantage, of course, is coupled with the ability to adjust the height of the tee for practicing with the driver.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A golf ball support for a driving range comprising:

a. a mat having a bottom face and a top face at a given height above the bottom face, the mat having a holder-receiving opening therethrough, and b. a one-piece golf ball tee holder comprising a resilient flat base and a central tubular shank extending upward from the base through the opening, the tubular shank being thickened inwardly at its upper end, the upper end being formed with a dished upper surface, the upper end having a central vertical slot comprising vertical parallel side surfaces and rounded ends, the interior of the tubular shank defining a cylindrical chamber for receiving the lower ends of broken tees, the flat base being covered by the bottom face of the mat surrounding the opening, the tubular shank having its upper end disposed at the given height to be flush with the top face of the mat so that the dished upper end provides a teeing surface for locating the ball in "tight lies" practice.

2. The combination as claimed in claim 1 additionally including a golf tee comprising a stem integrally formed with a ball-supporting cup having an upwardly facing dished surface, the golf tee being installed in the tee holder by having its stem disposed in the slot in the shank with the parallel side surfaces frictionally engaging opposite sides of the stem to adjustably support the tee in vertical disposition.

* * * * *